US006524777B1

(12) United States Patent
Whitesides et al.

(10) Patent No.: US 6,524,777 B1
(45) Date of Patent: Feb. 25, 2003

(54) METHOD OF ACTIVATING A PROTECTIVE LAYER ON A PHOTOGRAPHIC ELEMENT EMPLOYING AN ORGANIC SOLVENT IN THE WASH SOLUTION

(75) Inventors: Thomas H. Whitesides, Rochester, NY (US); Amy E. Jasek, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/944,489

(22) Filed: Aug. 30, 2001

(51) Int. Cl.[7] ..... G03C 1/76
(52) U.S. Cl. ..... 430/371; 430/403; 430/531
(58) Field of Search ..... 430/371, 403, 430/531

(56) References Cited

U.S. PATENT DOCUMENTS 4,948,775 A * 8/1990 Tsuji et al. ..... 427/152
6,194,130 B1 2/2001 Nair et al. ..... 430/350

FOREIGN PATENT DOCUMENTS

JP 04053791 * 2/1992
JP 07314895 * 5/1995

* cited by examiner

*Primary Examiner*—Hoa Van Le
(74) *Attorney, Agent, or Firm*—Chris P. Konkol

(57) ABSTRACT

The present invention is a method of forming a protective overcoat on a photographic element which element includes a processing-solution-permeable overcoat that becomes water-resistant in the final product without lamination or fusing. The method involves the incorporation of a small amount of a water-soluble organic solvent in the last step of the photographic process, i.e., during the washing step. This method allows the use of durable water-resistant protective overcoat materials with relatively high glass transition temperatures, that normally do not convert to impermeable films at low temperature, or without fusing.

15 Claims, No Drawings

METHOD OF ACTIVATING A PROTECTIVE LAYER ON A PHOTOGRAPHIC ELEMENT EMPLOYING AN ORGANIC SOLVENT IN THE WASH SOLUTION

FIELD OF THE INVENTION

The present invention relates to method of making a photographic imaged element having a protective overcoat that resists fingerprints, common stains, and spills. More particularly, the present invention involves a processing-solution-permeable overcoat in the manufactured photographic (imaging) element that becomes water resistant in the finished (imaged) product. The overcoat formulation comprises at least one water-dispersible hydrophobic polymer interspersed with a water-soluble polymer. The incorporation of a small amount of a water-soluble organic solvent in the last step of the photographic process, i.e., during the washing step, induces the formation of a durable, water-resistant film.

BACKGROUND OF THE INVENTION

Silver halide photographic elements contain light sensitive silver halide in a hydrophilic emulsion. An image is formed in the element by exposing the silver halide to light, or to other actinic radiation, and developing the exposed silver halide to reduce it to elemental silver. In color photographic elements, a dye image is formed as a consequence of silver halide development by one of several different processes. The most common process is to allow a by-product of silver halide development, oxidized silver halide developing agent, to react with a dye-forming compound called a coupler. The silver and unreacted silver halide are then removed from the photographic element, leaving a dye image. Formation of the image commonly involves liquid processing with aqueous solutions containing a developing agent that must penetrate the surface of the element in order to come into contact with silver halide and coupler. Thus, gelatin or similar natural or synthetic hydrophilic polymers have proven to be the binders of choice for silver-halide photographic elements.

Unfortunately, when gelatin or similar polymers are formulated so as to facilitate contact between the silver-halide crystals in the photographic element and aqueous processing solutions, the resulting product lacks fingerprint and stain resistance. This is problematic in view of the handling and environmental exposure that photographic images commonly experience under various circumstances. Thus, for example, fingerprints can permanently mark the image, or common household products, such as foods or beverages, coffee spills, mustard, and the like can easily stain the image.

There have been attempts over the years to provide protective layers for gelatin based photographic systems that will protect the images from damages by water or aqueous solutions. For example, various lamination techniques are known and practiced in the trade. U.S. Pat. Nos. 3,397,980, 3,697,277 and 4,999,266 describe methods of laminating a polymeric sheet film, as a protective layer, on a processed image. Protective coatings that need to be applied to the image after it is formed, however, adds a significant cost to the final imaged product.

A number of patents have been directed to water-resistant protective coatings that can be applied to a photographic element prior to development. For example, U.S. Pat. No. 2,706,686 describes the formation of a lacquer finish for photographic emulsions, with the aim of providing water—and fingerprint-resistance by coating the light-sensitive layer, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing.

U.S. Pat. No. 5,856,051 describes the use of hydrophobic particles with gelatin as the binder in an overcoat formulation. This invention demonstrated an aqueous coatable, water-resistant protective overcoat that can be incorporated into the photographic product, allows for appropriate diffusion of photographic processing solutions, and does not require a coating operation after exposure and processing. The hydrophobic polymers exemplified in U.S. Pat. No. 5,856,051 include polyethylene have a melting temperature (Tm) of 55 to 200° C., and are therefore capable of forming a water-resistant layer by fusing the layer at a temperature higher than the Tm of the polymer after the sample has been processed to generate the image. The coating solution is aqueous and can be incorporated in the manufacturing coating operation without any equipment modification. Again, however, fusing is required by the photofinishing laboratories to render the protective overcoat water-resistant. Similarly, commonly assigned U.S. Ser. No. 09/353,939 and U.S. Ser. No. 09/548,514, respectively, describe the use of a polystyrene-based material and a polyurethane-based material, with gelatin as the binder, in an overcoat for a photographic element, which overcoat can be fused into a water resistant overcoat after photographic processing is accomplished to generate an image.

Commonly assigned U.S. Ser. No. 09/235,436 discloses the use of a processing solution permeable overcoat that is composed of a urethane-vinyl copolymer having acid functionalities. Commonly assigned U.S. Ser. No. 09/235,437 and U.S. Ser. No. 09/448,213 disclose the use of a second polymer such as a water-soluble gelatin or polyvinyl alcohol to improve processibility and reduce coating defects.

PROBLEM TO BE SOLVED BY THE INVENTION

It has already been shown that protection of an imaged photographic element, for example a photographic print or film, can be achieved by applying a top (overcoat) layer to the photographic element during manufacture, which overcoat comprises a film-forming hydrophobic polymeric component dispersed together with a water-soluble, relatively low molecular weight polymer. During processing, the low molecular weight, water-soluble polymeric material is washed out of the coating, so that when the processed film is dried, the remaining hydrophobic polymer forms a durable protective film. However, not all hydrophobic materials work equally well for this application. For example, not all of them can form a film after processing or a film that is as water resistant as desirable, particularly at the relatively low temperatures that are typically used for drying the processed element. While some of these materials can be made to form such a film by a high temperature fusing step, the addition of this step to the process is inconvenient and expensive. Also, the type of materials that can be made to coalesce to form a film under typical photoprocessing conditions tend to be less durable than coating materials that require fusing.

It would be desirable provide an improved protective overcoat that is convenient and economical. It would also be desirable to obtain a water-resistant protective overcoat for a photographically imaged element without requiring the addition of laminating or fusing steps, without the need for high temperatures, and without requiring additional equipment to carry out photoprocessing or finishing.

SUMMARY OF THE INVENTION

The invention relates to the conversion of a process-permeable overcoat ("precursor protective layer") on a photographic element to a durable, water—and stain-resistant protective overcoat. In particular, the present method comprises the incorporation of a small amount of a water-soluble organic solvent in the last step of the photographic process, i.e., during the final washing step. Applicants have found that some polymers that are not useful or not ideal for making a durable overcoat layer in the normal process because incomplete or unsatisfactory film formation can be induced to form a durable, water-resistant film if washed in the presence of a water-soluble organic solvent. Thus, this invention substantially increases the scope of the materials that are useful for forming a process-permeable overcoat that is convertible to a water-resistant protective overcoat. In particular, materials that normally do not convert or coalesce to impermeable films at low temperature or without fusing, but which are expected to have particularly desirable protective properties, including water resistance and fingerprint resistance can be used according to the present invention.

DESCRIPTION OF THE PREFERRED EMBODIMENTS

The present invention provides a simple and inexpensive way to improve the water, stain and abrasion resistance of processed photographic elements. In accordance with the invention, a precursor protective layer is applied over the photographic element prior to exposure and processing.

By the term "water resistant" is meant herein that the photographic element after photoprocessing and drying does not imbibe water or that discoloring of the imaged side of the photographic element by water-based stains are prevented or minimized.

By the term "elevated temperature", as used in this application, to dry and/or facilitate coalescence of the water-dispersible polymer, is herein meant a temperature of from 30 to 80° C., preferably 45 to 60° C. In contrast, compared to the method of the present invention, "fusing" typically requires a pressure roller or belt and drying of the imaged element before fusing. Also, fusing generally requires higher temperatures, usually above 100° C.

As indicated above, the present invention comprises the incorporation of a small amount of a water-soluble organic solvent in at least the last step of the photographic process, i.e., during the final washing step. Typically, the washing step occurs after developing and after fixing and bleaching. There may optionally be more than one washing step. In any case, the final step is washing and the final solution applied in the sequence of solutions applied during photographic processing is a wash solution. The water-soluble organic solvent should be present during the final wash in order that it be present during the drying step, so that it can facilitate coalesce of the hydrophobic polymer in the protective layer in accordance with the invention.

Solvents useful for the process of the invention are those with appreciable solubility both in water and in organic media. Without wishing to be bound be theory, Applicants believe that the solvent partitions from the aqueous solution into the water-insoluble protective overcoat polymer, and thereby softens (plasticizes) the particles of polymer to the extent that facile continuous film formation can occur during drying.

The most effective solvents for this purpose are, therefore, those that are somewhat less volatile than water, so that substantial quantities of organic solvent remain in the nascent protective overcoat after the water has evaporated during drying. However, even materials that are more volatile than water can be used, since they can be retained by partitioning into the hydrophobic polymer and their evaporation thereby appropriately retarded. In any case, in the most preferred embodiment of the invention, the organic solvent largely volatilizes during the drying process, though solvents that do not volatilize, or that volatilize only slowly, can still be used for the process of the invention. Almost any water-miscible or partially water-soluble organic solvents can in principle be used, including alkyl, aryl, or alkaryl alcohols, for example, methanol, ethanol, propanol, isopropanol, butanol, isobutanol or tertiary butanol, phenol, substituted phenols, benzyl alcohol; amides and alkyl amides, such as formamide, dimethyl formamide, and N-methylpyrrolidone; sulfoxides and sulfones, such as dimethylsulfoxide, dimethylsulfone, and tetramethylene sulfone; ethers, esters and ether esters, such as glyme, diglyme, butyl carbitol, propyl carbitol, and butyl carbitol acetate; ketones, such as acetone, methyl ethyl ketone, methyl isobutyl ether, and cyclohexanone; and other soluble or moderately soluble organic materials, such as acetonitile, trimethylphosphate, triethyl phosphate or ethylene carbonate. Preferably, the solvents have 1 to 18 carbon atoms, more preferably 2 to 12 carbon atoms, most preferably 2 to 8 carbon atoms. The water solubility of the organic material should be at least 1%, more preferably at least 10%, and most preferably completely miscible with water. Ether alcohols such as butyl carbitol and propyl carbitol and ether esters such as butyl carbitol acetate are particularly preferred.

In one embodiment, the water-soluble organic solvent is present in an effective amount of 0.05 to 25 percent, preferably 0.1 to 20 percent, more preferably 0.5 to 15 percent, most preferably 0.5 to 5%, by weight of the wash solution.

In one embodiment, a photographic element processed according to the present invention preferably comprises: (a) a support; (b) at least one silver-halide emulsion layer superposed on a side of said support; and (c) overlying the silver emulsion layer, a processing-solution-permeable precursor-protective overcoat having a laydown of at least 0.54 $g/m^2$(50 $mg/ft^2$) comprising 30 to 95% by weight of solids, preferably 60 to 90 weight percent, of water-dispersible polymer particles having an average particle size of less than 500 nm, and 5 to 70%, by weight of solids, preferably 10 to 40 weight percent, of a water-soluble hydrophilic polymer such that more than 30 weight percent of the water-soluble polymer is washed out during photographic processing; wherein the weight ratio. of the water-dispersible polymer to the non-crosslinked hydrophilic polymer is between 50:50 to 90:10, preferably 60:40 to 85:15, whereby the overcoat forms a water-resistant overcoat after photoprocessing without fusing, namely by maintaining the photographic element at a temperature less than 100° C., preferably a temperature of from 30 to 80° C., more preferably 45 to 60° C. which is typically of normal photofinishing operations. No fusing equipment or processing is necessary. Preferably, conventional processing equipment and processing can be used substantially "as is" without substantial modification.

It may be desirable to employ somewhat higher temperatures in the dryer than typically used in traditional photoprocessing. For example, in some cases, stain resistance and/or water resistance of an imaged element having a protective overcoat may be enhanced, particularly when the overcoat (nascently protective) is coated simultaneously with the gelatin-based emulsion layers, by subjecting the product, after it emerges from the last photoprocessing step, to an elevated temperature, above about 75° C. for a sustained period of time beyond minimal drying of the photographic element, such that the temperature of photographic element can reach or approach said elevated temperature. This drying of the image element at elevated temperatures is believed to further facilitate coalescence of the latex in the overcoat, thus rendering the product more resistant to staining and/or water. A process utilizing this elevated temperature is disclosed in commonly assigned, copending U.S. Ser. No. 09,844,050, hereby incorporated by reference.

The dispersions of hydrophobic polymers used in this invention are latexes or hydrophobic polymers of any composition that can be stabilized in a water-based medium. Such hydrophobic polymers are generally classified as either condensation polymer or addition polymers. Condensation polymers include, for example, polyesters, polyamides, polyurethanes, polyureas, polyethers, polycarbonates, polyacid anhydrides, and polymers comprising combinations of the above-mentioned types. Addition polymers are polymers formed from polymerization of vinyl-type monomers including, for example, allyl compounds, vinyl ethers, vinyl heterocyclic compounds, styrenes, olefins. and halogenated olefins, unsaturated acids and esters derived form them, unsaturated nitriles, vinyl alcohols, acrylamides and methacrylamides, vinyl ketones, multifunctional monomers, or copolymers formed from various combinations of these monomers. Such latex polymers can be prepared in aqueous media using well-known free radical emulsion polymerization methods and may consist of homopolymers made from one type of the above-mentioned monomers or copolymers made from more than one type of the above-mentioned monomers. Polymers comprising monomers which form water-insoluble homopolymers are preferred, as are copolymers of such monomers. Preferred polymers may also comprise monomers which give water-soluble homopolymers, if the overall polymer composition is sufficiently water-insoluble to form a latex. Further listings of suitable monomers for addition type polymers are found in U.S. Pat. No. 5,594,047 incorporated herein by reference. The polymer can be prepared by emulsion polymerization, solution polymerization, suspension polymerization, dispersion polymerization, ionic polymerization (cationic, anionic), Atomic Transfer Radical Polymerization, and other polymerization methods known in the art of polymerization. The selection of water-dispersible particles to be used in the overcoat is based on the material properties one wishes to have as the protective overcoat in addition to water resistance.

In one embodiment, the hydrophobic polymer comprises epoxy-containing particles having a mean size of less than 5 microns, preferably less than 2 microns, and most preferably less than 0.5 microns, and further comprising a polymer having an acid number greater than 30 and less than 250, wherein the acid groups carried by the polymer have been neutralized by a base to a degree of neutralization of 50 to 95%.

The epoxy-containing particles comprises a material, a compound or resin, having a 1,2-epoxy functionality, more particularly, having on average greater than about 1.5 epoxide groups per molecule (on a measured basis). The epoxy material can be saturated or unsaturated, linear or branched, aliphatic, cycloaliphatic, aromatic or heterocyclic, and may bear substituents which do not materially interfere with the reaction with the carboxylic acid. Such substituents can include bromine or fluorine. The epoxy material may be monomeric or polymeric. Suitable epoxy resins include glycidyl ethers prepared by reacting epichlorohydrin with a compound containing at least 1.5 aromatic hydroxyl groups carried out under alkaline reaction conditions. Examples of other epoxy resins suitable for use in the invention include diglycidyl ethers of dihydric compounds, epoxy novolacs (substituted or unsubstituted phenyl-containing epoxy materials) and cycloaliphatic epoxies. Generally, epoxy resins contain a distribution of compounds with a varying number of repeat units.

Preferably, the epoxy material is a resin that is a diglycidyl ether of a dihydric phenol, a diglycidyl ether of a hydrogenated dihydric phenol, an aliphatic glycidyl ether, an epoxy novolac, or a cycloaliphatic epoxy. Diglycidyl ethers of dihydric phenols can be produced, for example, by reacting an epihalohydrin with a dihydric phenol in the presence of an alkali. Examples of suitable dihydric phenols include: 2,2-bis(4-hydroxyphenyl) propane(bisphenol-A), 2,2-bis(4-hydroxy-3-tert-butylphenyl) propane, 1,1-bis(4-hydroxyphenyl) ethane;1,1-bis(4-hydroxyphenyl) isobutane, bis(2-hydroxy- 1 -naphthyl) methane; 1 ,5-dihydroxynaphthalene, 1,1-bis(4-hydroxy-3-alkylphenyl) ethane and the like. Suitable dihydric phenols can also be obtained from the reaction of phenol with aldehydes such as formaldehyde (bisphenol-F). Diglycidyl ethers of dihydric phenols include advancement products of the above diglycidyl ethers of dihydric phenols with phenolic compounds such as bisphenol-A, such as those described in U.S. Pat. Nos. 3,477,990 and4,734,468. Diglycidyl ethers of hydrogenated dihydric phenols can be produced, for example, by hydrogenation of dihydric phenols followed by glycidation reaction with an epihalohydrin in the presence of a Lewis acid catalyst and subsequent formation of the glycidyl ether by reaction with sodium hydroxide.

Aliphatic glycidyl ethers can be produced, for example, by reacting an epihalohydrin with an aliphatic diol in the presence of a Lewis acid catalyst followed by conversion of the halohydrin intermediate to the glycidyl ether by reaction with sodium hydroxide. Examples of suitable aliphatic glycidyl ethers include for example, diglycidyl ethers of 1,4 butanediol, neopentyl glycol, cyclohexane dimethanol, hexanediol, polypropylene glycol, and like diols and glycols; and triglycidyl ethers of trimethylol ethane and trimethylol propane. Epoxy novolacs can be produced by condensation of formaldehyde and a phenol followed by glycidation by reaction of an epihalohydrin in the presence of an alkali. The phenol can be, for example, phenol, cresol, nonylphenol and t-butylphenol. Cycloaliphatic epoxies can be produced by epoxidizing a cycloalkene-containing compound with greater then one olefinic bond with peracetic acid.

Commercial examples of preferred epoxy resins include, for example, EPON™ resin 1001F, 1002F, 1004F, 1007F, 1009F, 2002, 2003, 2004, 2005, 2012, 2014, 2024, 2042, 3001, 3002 available from Shell Chemical Company, and epoxy cresol novolac resin (poly((o-cresyl glycidyl ether)-co-formaldehyde)) available from Sigma-Aldrich Chemical Co.

The water-dispersible epoxy particles comprise, in addition to the epoxy material, a substantially amorphous, thermoplastic polymer having carboxylic acid groups, which polymer can be characterized by the acid number, which is preferably greater than or equal to 60 and relatively soluble in water at a pH of greater than 7. Preferably, the acid number is less than or equal to 200, more preferably less than or equal to 100.

The carboxylated thermoplastic polymers utilized in this invention are preferably prepared by conventional free radical polymerization techniques from at least one ethylenically unsaturated monomer and at least one ethylenically unsaturated acid monomer. The choice of the unsaturated monomer(s) is dictated by the intended end use of the coating composition and is practically unlimited. A variety of acid monomers can be used. Their selection is dependent on the desired final polymer properties.

This acid monomer can be an ethylenically unsaturated acid, mono-protic or diprotic, anhydride or monoester of a dibasic acid, which is copolymerizable with the other monomer(s) used to prepare the polymer. The most preferred acid monomers are acrylic acid, methacrylic acid, and itaconic acid.

The acid number of the carboxylated thermoplastic polymers is between 30 and 250, preferably between 30 and 200. The acid number is the number of milligrams of potassium hydroxide required to neutralize one gram of the polymer. For purposes of illustration, an acid number of 100 corresponds to the presence in the polymer of either 12.8% acrylic acid, 15.3% of methacrylic acid, 11.5% of itaconic acid, or 10.3% of maleic or fumaric acid.

Ethylenically unsaturated monomers which can be used for preparing the carboxylated thermoplastic polymers of the invention include virtually all monomers capable of undergoing addition polymerization to produce polymers free of ionic charge groups and essentially water-insoluble. Typical useful monomers thus include, for example, methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, 2-hydroxypropyl methacrylate, acrylonitrile, methacrylonitrile, vinyl acetate, vinyl propionate, vinylidene chloride, vinyl chloride, styrene, t-butyl styrene, vinyl toluene, butadiene, isoprene, and the like.

The polymerization process is initiated in general with free radical initiators. Free radicals of any sort may be used. Preferred initiators include persulfate, peroxides, azo compounds, and redox initiators. The amount of initiator can vary from 0.01% to 2% by the weight of monomer, but is preferably from 0.03 to 1 % by weight thereof. Organic peroxides and organic peresters include, for example, benzoyl peroxide, dichlorobenzoyl peroxide, dicumyl peroxide, di-tert-butyl peroxide, lauroyl peroxide, tert-butyl peracetate, 2,5-dimethyl-2,5-di(tert-butylperoxy)hexane-3, 2,5-dimethyl-2,5-di(tert-butylperoxy)hexane, tert-butyl perbenzoate, tert-butyl perphenyl acetate, tert-butylperisobutylate, tert-butyl per-secoctoate, tert-butyl perpivalate, cumyl perpivalate and tert-butyl perdiethyl acetate, and azo compounds include, for example, azobisisobutylnitrile and dimethyl azoisobutylate.

A preferred method of making epoxy-containing particles for the coating composition according to the present invention comprises (1) dissolving into a volatile solvent mixture an oil-soluble epoxy-functional compound and a polymer having an acid number greater than 30 and less than 250, preferably greater than 60 and less than 150, and optionally a surfactant, (2) adding to the organic solvent medium in a base to neutralize the acid groups to a degree of neutralization less than 95%, preferably less than 90%, (3) dispersing the resulting organic phase into an aqueous medium optionally containing a surfactant, and (4) removing the volatile solvent mixture. Preferably, the volatile solvent mixture comprises a water immiscible organic solvent as the major component and a water miscible organic solvent as a minor component. Such a process advantageously provides very fine submicron particles having a narrow particle size distribution. The dispersions also have excellent stability during storage. Further details of epoxy polymers are disclosed in commonly assigned, copending application Ser. No. 09,699,789, hereby incorporated by reference.

In another preferred embodiment, the water-dispersible polymer of this invention are polyurethanes, preferably segmented polyurethanes. Polyurethanes are the polymerization reaction product of a mixture comprising polyol monomers and polyisocyanate monomers. A preferred segmented polyurethane is described schematically by the following structure (I):

Structure I

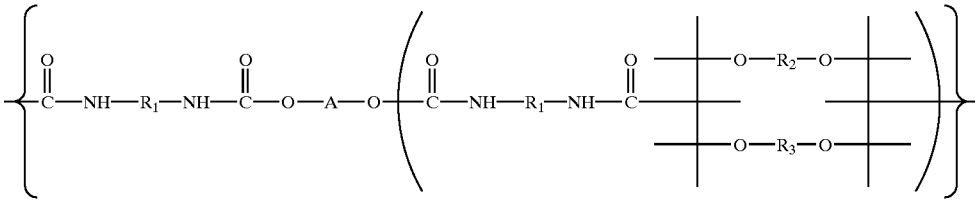

wherein $R_1$ is preferably a hydrocarbon group having a valence of two, more preferably containing a substituted or unsubstituted, cyclic or non-cyclic, aliphatic or aromatic group, most preferably represented by one or more of the following structures:

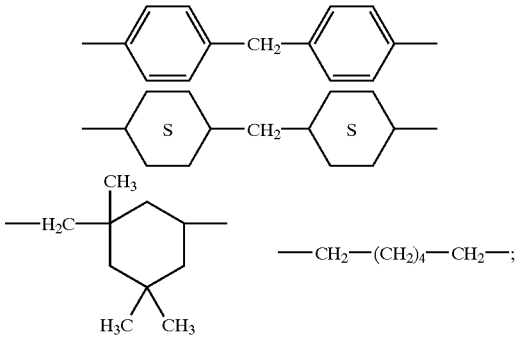

and wherein A represents a polyol, such as a) a dihydroxy polyester obtained by esterification of a dicarboxylic acid such as succinic acid, adipic acid, suberic acid, azelaic acid, sebacic acid, phthalic, isophthalic, terephthalic, tetrahydrophthalic acid, and the like, and a diol such as ethylene glycol, propylene-1,2-glycol, propylene-1,3-glycol, diethylene glycol, butane-1,4-diol, hexane-1,6-diol, octane-1,8-diol, neopentyl glycol, 2-methyl propane-1,3-diol, or the various isomeric bis-hydroxymethylcyclohexanes; b) a polylactone such as polymers of ε-caprolactone and one of the above mentioned diols; c) a polycarbonate obtained, for example, by reacting one of the above-mentioned diols with diaryl carbonates or phosgene; or d) a polyether such as a polymer or copolymer of styrene oxide, propylene oxide, tetrahydrofuran, butylene oxide or epichlorohydrin;

$R_3$ is a phosphonate, carboxylate or sulfonate group, and.

$R_2$ is a diamine or diol having a molecular weight less than about 500. Suitable well known diamine chain extenders useful herein include ethylene diamine, diethylene triamine, propylene diamine, butylene diamine, hexamethylene diamine, cyclohexylene diamine, phenylene diamine, tolylene diamine, xylylene diamine, 3,3'-dinitrobenzidene, ethylene methylenebis (2-chloroaniline), 3,3'-dichloro-4,4'-biphenyl diamine. 2,6-diaminopyridine, 4,4'-diamino diphenylmethane, and adducts of diethylene triamine with acrylate or its hydrolyzed products. Also included are materials such as hydrazine, substituted hydrazines such as, for example, dimethyl hydrazine, 1,6-hexamethylene-bis-hydrazine, carbodihydrazide, hydrazides of dicarboxylic acids and sulfonic acids such as adipic acid mono- or dihydrazide, oxalic acid dihydrazide, isophthalic acid dihydrazide, tartaric acid dihydrazide, 1,3-phenylene disulfonic acid dihydrazide, omega-amino-caproic acid dihydrazide, hydrazides made by reacting lactones with hydrazine such as gamma-hydroxylbutyric hydrazide, bis-semi-carbazide, bis-hydrazide carbonic esters of glycols such as any of the glycols mentioned above. Suitable well known diol chain extenders may be any of the glycols or diols listed above for A. $R_3$ is a phosphonate, carboxylate or sulfonate group.

The number of repeating units of Structure I can range from 2 to 200, preferably 20 to 100. The amount of the hard-segment (in the right-hand parenthesis) is preferably 40 to 70 percent by weight. The weight ratio of the $OR_3O$ to the $OR_2O$ repeating unit preferably varies from 0 to 0.1. The water-dispersible polyurethane employed in the invention may be prepared as described in "Polyurethane Handbook", Hanser Publishers, Munich Vienna, 1985.

The term "polyurethane", as used herein, includes branched and unbranched copolymers, as well as IPNs (interpenetrating polymer networks) and semi-IPNs comprising at least two polymers, at least one of which is a polyurethane.

In one embodiment of the present invention, the water-dispersible polymer is a polyurethane containing pH responsive groups such as acid functionalities and have an acid number greater than or equal to 5, preferably less than or equal to 40, more preferably less than or equal to 30, most preferably from 10 to 25. The weight ratio of the optional vinyl polymer in the polymer can vary from 0 to 80 percent, including a interpenetrating network of a urethane polymer and a vinyl polymer if the amount of vinyl polymer is substantially greater than zero.

In another embodiment of the present invention, the water-dispersible polymer is a polyurethane-containing component that is an IPN or semi-IPN comprising a polyurethane and a vinyl polymer. By the term "vinyl polymer" is meant an addition polymer that is the reaction product of ethylenically unsaturated monomers. Particularly preferred vinyl polymers are acrylics. Preparation of an aqueous dispersion of a polyurethane-containing component, when a single copolymer, is well known in the art. In a preferred method of preparation, the first step is the formation of a medium molecular weight isocyanate terminated prepolymer by the reaction of suitable di or polyol with a stoichiometric excess of di or polyisocyanates. The prepolymer is then generally dispersed in water via water-solubilizing/dispersing groups that are introduced either into the prepolymer prior to chain extension, or are introduced as part of the chain extension agent. Therefore, small particle size stable dispersions can frequently be produced without the use of an externally added surfactant. The prepolymer in the aqueous solution is then subjected to chain extension using diamines or diols to form the "fully reacted" polyurethane.

Polyols useful for the preparation of polyurethane dispersions of the present invention include polyester polyols prepared from one or more diols (e.g. ethylene glycol, butylene glycol, neopentyl glycol, hexane diol or mixtures of any of the above) and one or more dicarboxylic acids or anhydrides (succinic acid, adipic acid, suberic acid, azelaic acid, sebacic acid, phthalic acid, isophthalic acid, maleic acid and anhydrides of these acids), polylactone diols prepared from lactones such as caprolactone reacted with a diol, polyesteramides containing polyols prepared by inclusion of amino-alcohols such as ethanol amine during the polyesterification process, polyether polyols prepared from for example, ethylene oxide, propylene oxide or tetrahydrofuran, polycarbonate polyols prepared from reacting diols with diaryl carbonates, and hydroxyl terminated polyolefins prepared from ethylenically unsaturated monomers. Combinations of such polyols are also useful. As mentioned below, polysiloxane polyols are also useful in forming a polyurethane. See, for example, U.S. Pat. No. 5,876,9810 to Anderson, hereby incorporated by reference, for such monomers. A polyester polyol is preferred for the present invention.

Polyisocyanates useful for making the prepolymer may be aliphatic, aromatic or araliphatic. Examples of suitable polyisocyanates include one or more of the following: toluene diisocyanate, tetramethylene diisocyanate, hexamethylene diisocyanate, isophorone diisocyanate, ethylethylene diisocyanate, 2,3-dimethylethylene diisocyanate, 1-methyltrimethylene diisocyanate, 1,3-cyclopentylene diisocyanate, 1,4-cyclohexylene diisocyanate, 1,3-phenylene diisocyanate, 4,4'-biphenylene diisocyanate, 1,5-naphthalene diisocyanate, bis-(4-isocyanatocyclohexyl)-metbane, 4,4'-diisocyanatodiphenyl ether, tetramethyl xylene diisocyanate, polymethylene polyphenyl polyisocyanates and the like. Methylene bis(isocyanato cyclohexane) is preferred.

Preferably, a suitable portion of the prepolymer also contains at least one comparatively unreactive pendant carboxylic group, in salt form or preferably neutralized with a suitable basic material to form a salt during or after prepolymer formation or during formation of the dispersion. This helps provide permeability of processing solutions through the overcoat at pHs greater than 7 and as well as dispersibility in water. Suitable compounds that are reactive with the isocyanate groups and have a group capable of forming an anion include, but are not limited to the following: dihydroxypropionic acid, dimethylolpropionic acid, dihydroxysuccinic acid and dihydroxybenzoic acid. Other suitable compounds are the polyhydroxy acids which can be prepared by oxidizing monosaccharides, for example gluconic acid, saccharic acid, mucic acid, glucuronic acid and the like. Such a carboxylic-containing reactant is preferably an α,α-dimethylolalkanoic acid, especially 2,2-dimethylol propionic acid.

Suitable tertiary amines which may be used to neutralize the acid and form anionic groups for water dispersibility are trimethylamine, triethylamine, dimethylaniline, diethylaniline, triphenylamine and the like.

Chain extenders suitable for optionally chain extending the prepolymer are, for example, active-hydrogen containing molecules such as polyols, amino alcohols, ammonia, primary or secondary aliphatic, aromatic, alicyclic araliphatic or heterocyclic amines especially diamines. Diamines suitable for chain extension of the pre- polyurethane include ethylenediamine, diaminopropane, hexamethylene diamine, hydrazine, aminoethyl ethanolamine and the like.

Some examples of polyurethane-containing components used in the practice of this invention that are commercially available include NeoPac® R-9000, R-9699 and R-9030 from NeoResins (Wilmington, Del.), Sancure® AU4010 from BF Goodrich (Akron, Ohio), and Flexthane® 620, 630, 790 and 791 from Air Products. An example of the polyurethane-containing copolymer useful in the practice that is commercially available is the NeoRez® R9679.

In accordance with one embodiment of this invention, a urethane-vinyl IPN may be prepared by polymerizing vinyl addition monomers in the presence of the polyurethane prepolymer or the chain extended polyurethane. The solution of the water-dispersible polyurethane prepolymer in vinyl monomer may be produced by dissolving the prepolymer in one or more vinyl monomers before dispersing the prepolymer in water.

Suitable vinyl monomers in which the prepolymer may be dissolved contain one or more polymerizable ethylenically unsaturated groups. Preferred monomers are liquid under the temperature conditions of prepolymer formation, although the possibility of using solid monomers in conjunction with organic solvents is not excluded.

The vinyl polymers useful for the present invention include those obtained by copolymerizing one or more ethylenically unsaturated monomers including, for example, alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl metbacrylate, the nitrile and amides of the same acids such as acrylonitrile, methacrylonitrile, and methacrylamide, vinyl acetate, vinyl propionate, vinylidene chloride, vinyl chloride, and vinyl aromatic compounds such as styrene, t-butyl styrene and vinyl toluene, dialkyl maleates, dialkyl itaconates, dialkyl methylene-malonates, isoprene, and butadiene. Suitable ethylenically unsaturated monomers containing carboxylic acid groups include acrylic monomers such as acrylic acid, methacrylic acid, ethacrylic acid, itaconic acid, maleic acid, fumaric acid, monoalkyl itaconate including monomethyl itaconate, monoethyl itaconate, and monobutyl itaconate, monoalkyl maleate including monomethyl maleate, monoethyl maleate, and monobutyl maleate, citraconic acid, and styrene carboxylic acid. Suitable polyethylenically unsaturated monomers include butadiene, isoprene, allylmethacrylate, diacrylates of alkyl diols such as butanediol diacrylate and hexanediol diacrylate, divinyl benzene and the like.

The prepolymer/vinyl monomer solution may be dispersed in water using techniques well known in the art. Preferably, the solution is added to water with agitation or, alternatively, water may be stirred into the solution. Polymerization of the vinyl monomer or monomers is brought about by free radical initiators at elevated temperatures.

Free radicals of any sort may be used including persulfates (such as ammonium persulfate, potassium persulfate, etc., peroxides (such as hydrogen peroxide, benzoyl peroxide, cumene hydroperoxide, tertiary butyl peroxide, etc.), azo compounds (such as azobiscyanovaleric acid, azoisobutyronitrile, etc.), and redox initiators (such as hydrogen peroxide-iron(II) salt, potassium persulfate-sodium hydrogen sulfate, etc.). Preferable free radical initiators are the ones that partition preferably into the oil phase such as the azo-type initiators. Common chain transfer agents or mixtures thereof known in the art, such as alkylmercaptans, can be used to control the polymer molecular weight.

In another embodiment of the invention, the water-dispersible polymer is an essentially hydrophobic, substantially amorphous, thermoplastic polyester polymer in which ionic groups or moieties are present in sufficient number to provide water dispersibility prior to coating. The polyester dispersions provide advantageous properties such as good film-formation, good chemical-resistance, wet-abrasion resistance, excellent fingerprint resistance, toughness, elasticity and durability. Furthermore, the polyesters exhibit tensile and flexural strength and resistance to various oils.

Procedures for the preparation of polyester ionomers are described in U.S. Pat. Nos. 3,018,272; 3,563,942; 3,734,874; 3,779,993; 3,929,489; 4,307,174, 4,395,475, 5,939,355 and 3,929,489, the disclosures of which are incorporated herein by reference. The substantially amorphous polyesters useful in this invention comprise dicarboxylic acid recurring units typically derived from dicarboxylic acids or their functional equivalents and diol recurring units typically derived from diols. Generally, such polyesters are prepared by reacting one or more diols with one or more dicarboxylic acids or their functional equivalents (e.g. anhydrides, diesters or diacid halides), as described in detail in the cited patents. Such diols, dicarboxylic acids and their functional equivalents are sometimes referred to in the art as polymer precursors. It should be noted that, as known in the art, carbonylimino groups can be used as linking groups rather than carbonyloxy groups. This modification is readily achieved by reacting one or more diamines or amino alcohols with one or more dicarboxylic acids or their functional equivalents. Mixtures of diols and diamines can be used if desired.

Conditions for preparing the polyesters useful in this invention are known in the art as described above. The polymer precursors are typically condensed in a ratio of at least 1 mole of diol for each mole of dicarboxylic acid in the presence of a suitable catalyst at a temperature of from about 125° to about 300° C. Condensation pressure is typically from about 0.1 mm Hg to about one or more atmospheres. Low-molecular weight by-products can be removed during condensation, e.g. by distillation or another suitable technique. The resulting condensation polymer is polycondensed under appropriate conditions to form a polyester. Polycondensation is usually carried out at a temperature of from about 150° to about 300° C. and a pressure very near vacuum, although higher pressures can be used.

Polyester ionomers, useful in the present composition, contain at least one ionic moiety, which can also be referred to as an, ionic group, functionality, or radical. In a preferred embodiment of the invention, the recurring units containing ionic groups are present in the polyester ionomer in an amount of from about 1 to about 12 mole percent, based on the total moles of recurring units. Such ionic moieties can be provided by either ionic diol recurring units and/or ionic dicarboxylic acid recurring units, but preferably by the latter. Such ionic moieties can be anionic or cationic in nature, but preferably, they are anionic. Exemplary anionic ionic groups include carboxylic acid, sulfonic acid, and disulfonylimino and their salts and others known to a worker of ordinary skill in the art. Sulfonic acid ionic groups, or salts thereof, are preferred.

One type of ionic acid component has the structure

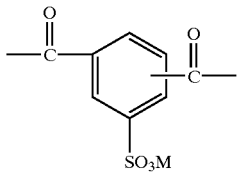

where M=H, Na, K or $NH_4$.

Ionic dicarboxylic acid recurring units can be derived from 5-sodiosulfobenzene- 1,3-dicarboxylic acid, 5-sodiosulfocyclohexane- 1,3-dicarboxylic acid, 5-(4-sodiosulfophenoxy)benzene-1,3-dicarboxylic acid, 5-(4-sodiosulfophenoxy)cyclohexane-1,3-dicarboxylic acid, similar compounds and functional equivalents thereof and others described in U.K. Patent Specification No. 1,470,059 (published Apr. 14, 1977). Other suitable polyester ionomers for protective overcoats in the imaged elements of the present invention are disclosed in U.S. Pat. Nos. 4,903,039 and 4,903,040, which are incorporated herein by reference.

Another type of ionic dicarboxylic acid found useful in the practice of this invention are those having units represented by the formula:

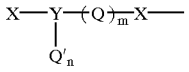

wherein each of m and n is 0 or 1 and the sum of m and n is 1; each X is carbonyl; as the formula:

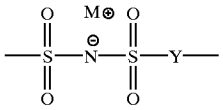

Q' has the formula:

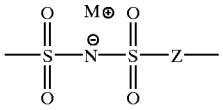

Y is a divalent aromatic radical, such as arylene (e.g. phenylene, naphthalene, ylylene, etc.) or arylidyne (e.g. phenenyl, naphthylidyne, etc.); Z is a monovalent aromatic radical, such as aryl, aralkyl or alkaryl (e.g. phenyl, p-methylphenyl, naphthyl, etc.), or alkyl having from I to 12 carbon atoms, such as methyl, ethyl, isopropyl, n-pentyl, neopentyl, 2-chlorohexyl, etc., and preferably from 1 to 6 carbon atoms; and M is a solubilizing cation and preferably a monovalent cation such as an alkali metal or ammonium cation.

In accordance with this invention, the precursor-protective overcoat preferably comprises, in addition to the water-dispersible polymer described above, at least one water-soluble hydrophilic polymer. Examples of such water-soluble polymers that may be added include polyvinyl alcohol, cellulose ethers, poly(N-vinyl amides), polyacrylamides, polyesters, poly(ethylene oxide), dextrans, starch, uncrosslinked gelatin, whey, albumin, poly(acrylic acid), poly(ethyl oxazolines), alginates, gums, poly (methacrylic acid), poly(oxymethylene), poly (ethyleneimine), poly(ethylene glycol methacrylate), poly (hydroxy-ethyl methacrylate), poly(vinyl methyl ether), poly(styrene sulfonic acid), poly(ethylene sulfonic acid), poly(vinyl phosphoric acid) and poly(maleic acid) and the like. Such materials are included in "Handbook of Water-Soluble Gums and Resins" by Robert l. Davidson (McGraw-Hill Book Company, 1980) or "Organic Colloids" by Bruno Jirgensons (Elsvier Publishing Company, 1958). In a preferred embodiment, the polymer is polyvinyl alcohol, which polymer has been found to yield coatings that are relatively uniform and to enhance the diffusion rate of the developer into the underlying emulsions.

The preferred hydrophilic polymer is polyvinyl alcohol. The term "polyvinyl alcohol" referred to herein means a polymer having a monomer unit of vinyl alcohol as a main component. Polyvinyl alcohol is typically prepared by substantial hydrolysis of polyvinyl acetate. Such a "polyvinyl alcohol" includes, for example, a polymer obtained by hydrolyzing (saponifying) the acetate ester portion of a vinyl acetate polymer (exactly, a polymer in which a copolymer of vinyl alcohol and vinyl acetate is formed), and polymers obtained by saponifying a trifluorovinylacetate polymer, a vinyl formate polymer, a vinyl pivalate polymer, a tert-butylvinylether polymer, a trimethylsilylvinylether polymer, and the like (the details of "polyvinyl alcohol" can be referred to, for example, "World of PVA", Edited by the Poval Society and Published by Kobunshi Kankoukai, Japan, 1992 and "Poval", Edited by Nagano et al. and Published by Kobunshi Kankoukai, Japan, 1981). The degree of hydrolysis (or saponification) in the polyvinyl alcohol is preferably at least about 70 % or more, more preferably at least about 80 %. Percent hydrolysis refers to mole percent. For example, a degree of hydrolysis of 90% refers to polymers in which 90 mol % of all copolymerized monomer units of the polymer are vinyl alcohol units. The remainder of all monomer units consists of monomer units such as ethylene, vinyl acetate, vinyl trifluoroacetate and other comonomer units which are known for such copolymers. Most preferably, the polyvinyl alcohol has a weight average molecular weight (MW) of less than 150,000, preferably less than 100,000, and a degree of hydrolysis greater than 70%. If the MW is greater than 100,000, the degree of hydrolysis is preferably less than 95%. Preferably, the degree of hydrolysis is 85 to 90% for a polyvinyl alcohol having a weight average MW of 25,000 to 75,000. These preferred limitations may provide improved manufacturability and processibility. The polyvinyl alcohol is selected to make the coating wettable, readily processable, and in a substantial amount, to readily,. not sluggishly, come out of the coating during processing, thereby yielding the final water-resistant product. The optimal amount of polyvinyl alcohol depends on the amount of dry coverage of water-dispersible polymer. In one preferred embodiment of the invention, the polyvinyl alcohol is present in the overcoat in the amount between 1 and 60 weight percent of the water-dispersible polymer, preferably between 5 and 50 weight percent of the water-dispersible polymer, most preferably between 10 and 45 weight percent of the water-dispersible polymer.

Without wishing to be bound by theory, it is believed that the water-soluble polymer and water-dispersible polymer form a biphasic mixture. Since the water-soluble polymer, during processing is washed out, it is necessary to close the pores left behind. The solvent according to the present invention promotes coalescence by partitioning into the hydrophobic particles and softens them, allowing them to coalesce, as mentioned above. Since the solvent used in the present invention has limited volatility or is retained by partitioning into the hydrophobic polymer, the water is removed before removing all of the solvent, the hydrophobic polymer particles remains soft for a period of time after the water is removed.

Optionally, the coating composition in accordance with the invention may also contain suitable crosslinking agents for crosslinking the water-dispersible polymer. Such an additive can improve the adhesion of the overcoat layer to the substrate below as well as contribute to the cohesive strength of the layer. Crosslinkers such as epoxy compounds, polyfunctional aziridines, methoxyalkyl melamines, triazines, polyisocyanates, carbodiimides, polyvalent metal cations, and the like may all be considered. If a crosslinker is added, care must be taken that excessive amounts are not used as this will decrease the permeability of the processing solution. The crosslinker may be added to the mixture of water-dispersible component and any additional polymers.

The hydrophilic polymer used in the precursor layer according to the present invention can include gelatin if it is substantially non-crosslinked or if the crosslinked gelatin in the precursor layer is hydrolyzed during processing by treatment with an enzyme solution. Further details of the use of such an enzyme containing imaging element is described in commonly assigned U.S. Ser. No. 09,591,430 herein incorporated by reference in its entirety. For example, in one embodiment of the invention, the overcoat is applied to the imaging element as a composition comprising 10 to 50% by weight gelatin and 50 to 90% by weight of water-dispersible particles (by weight of dry laydown of the entire overcoat) having an average diameter of 10 to 500 nm. Since gelatin comprises a substantial portion of the overcoat layer, photographic elements containing this overcoat are readily manufactured using conventional photographic coating equipment.

The protective overcoat should be clear, i.e., transparent, and is preferably colorless. But it is specifically contemplated that the polymer overcoat can have some color for the purposes of color correction, or for special effects, so long as it does not detrimentally affect the formation or viewing of the image through the overcoat. Thus, there can be incorporated into the polymer a dye that will impart color or tint. In addition, additives can be incorporated into the polymer that will give the overcoat various desired properties. For example, a UV absorber may be incorporated into the polymer to make the overcoat UV absorptive, thus protecting the image from UV induced fading. Other compounds may be added to the coating composition, depending on the functions of the particular layer, including surfactants, emulsifiers, coating aids, lubricants, matte particles, rheology modifiers, crosslinking agents, antifoggants, inorganic fillers such as conductive and nonconductive metal oxide particles, pigments, magnetic particles, biocide, and the like. The coating composition may also include a small amount of organic solvent, preferably the concentration of organic solvent is less than 1 percent by weight of the total coating composition. The invention does not preclude coating the desired polymeric material from a volatile organic solution or from a melt of the polymer.

Examples of coating aids include surfactants, viscosity modifiers and the like. Surfactants include any surface-active material that will lower the surface tension of the coating preparation sufficiently to prevent edge-withdrawal, repellencies, and other coating defects. These include alkyloxy—or alkylphenoxypolyether or polyglycidol derivatives and their sulfates, such as nonylphenoxypoly (glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl) sulfosuccinate (Aerosol OT), and alkylcarboxylate salts such as sodium decanoate.

The surface characteristics of the overcoat can be modified by the conditions under which the surface is optionally fused. For example, in contact fusing, the surface characteristics of the fusing element that is used to fuse the polymers to form the continuous overcoat layer can be selected to impart a desired degree of smoothness, texture or pattern to the surface of the element. Thus, a highly smooth fusing element will give a glossy surface to the imaged element, a textured fusing element will give a matte or otherwise textured surface to the element, a patterned fusing element will apply a pattern to the surface of the element, etc.

Matte particles well known in the art may also be used in the coating composition of the invention, such matting agents have been described in Research Disclosure No. 308119, published Dec. 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include hydroxyl, carboxyl, carbodiimide, epoxide, aziridine, vinyl sulfone, sulfinic acid, active methylene, amino, amide, allyl, and the like.

In order to reduce the sliding friction of the photographic elements in accordance with this invention, the water-dispersible polymers may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004,927, and 4,047,958, and in British Patent Nos. 955, 061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722, 1,198,387; 1,430,997; 1,466,304; 1,320,757; 1,320,565; and 1,320,756; and in German Patent Nos. 1,284,295 and 1,284, 294; (3) liquid paraffin and paraffin or wax like materials such as camauba wax, natural and synthetic waxes, petroleum waxes, mineral waxes, silicone-wax copolymers and the like; (4) perfluoro- or fluoro—or fluorochloro-containing materials, which include poly(tetrafluoroethylene), poly (trifluorochloroethylene), poly(vinylidene fluoride, poly (trifluorochloroethylene-co-vinyl chloride), poly(meth) acrylates or poly(meth)acrylamides containing perfluoroalkyl side groups, and the like. Lubricants useful in the present invention are described in further detail in Research Disclosure No.308119, published Dec. 1989, page 1006.

The support material used with this invention can comprise various polymeric films, papers, glass, and the like.

The thickness of the support is not critical. Support thicknesses of 2 to 15 mils (0.002 to 0.0 15 inches) can be used. Biaxially oriented support laminates can be used with the present invention. These supports are disclosed in commonly owned U.S. Pat. Nos. 5,853,965, 5,866,282, 5,874,205, 5,888,643, 5,888,681, 5,888,683, and 5,888,714, incorporated in their entirety by reference herein. These supports include a paper base and a biaxially oriented polyolefin sheet, typically polypropylene, laminated to one or both sides of the paper base. At least one photosensitive silver halide layer is applied to the biaxially oriented polyolefin sheet.

The coating composition of the invention can be applied by any of a number of well known techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in Research Disclosure No. 308119, Published Dec. 1989, pages 1007 to 1008. Preferably, a commercial embodiment involve simultaneous co-extrusion.

The laydown of the overcoat will depend on its field of application. For a photographic element, the laydown of the polyurethane-containing copolymer is suitably at least 0.54 $g/m^2$ (50 $mg/ft^2$), preferably 1.08 to 5.38 $g/m^2$ (100 to 500 $mg/ft^2$), most preferably 1.61 to 3.23 $g/m^2$(150 to 300 $mg/ft^2$). It may be advantageous to increase the amount of polyvinyl alcohol in the overcoat as the laydown increases in order to improve the developability.

After applying the coating composition to the support, it may be dried over a suitable period of time, for example 2 to 4 minutes. In the event of cracking, especially at lower levels of polyvinyl alcohol or when using an alternative film-forming polymer, it may be advantageous to adjust the temperature and/or humidity of the drying step to eliminate or reduce this cracking problem. Without wishing to be bound by theory, it is believed that higher levels of polyvinyl alcohol with limited degree of hydrolysis reduces the tendency of the polyvinyl alcohol to block the release of water during drying, which might otherwise occur with overly fast film formation and drying. Thus, polyvinyl alcohol according to one embodiment of the invention, by delaying film formation allows the release of water during drying which if blocked might otherwise adversely affect the uniformity of the overcoat.

Photographic elements can contain conductive layers incorporated into multilayer photographic elements in any of various configurations depending upon the requirements of the specific photographic element. Preferably, the conductive layer is present as a subbing or tie layer underlying a magnetic recording layer on the side of the support opposite the photographic layer(s). However, conductive layers can be overcoated with layers other than a transparent magnetic recording layer (e.g., abrasion-resistant backing layer, curl control layer, pelloid, etc.) in order to minimize the increase in the resistivity of the conductive layer after overcoating. Further, additional conductive layers also can be provided on the same side of the support as the photographic layer(s) or on both sides of the support. An optional conductive subbing layer can be applied either underlying or overlying a gelatin subbing layer containing an antihalation dye or pigment. Alternatively, both antihalation and antistatic functions can be combined in a single layer containing conductive particles, antihalation dye, and a binder. Such a hybrid layer is typically coated on the same side of the support as the sensitized emulsion layer. Additional optional layers can be present as well. An additional conductive layer can be used as an outermost layer of a photographic element, for example, as a protective layer overlying an image-forming layer. When a conductive layer is applied over a sensitized emulsion layer, it is not necessary to apply any intermediate layers such as barrier or adhesion-promoting layers between the conductive overcoat layer and the photographic layer(s), although they can optionally be present. Other addenda, such as polymer lattices to improve dimensional stability, hardeners or cross-linking agents, surfactants, matting agents, lubricants, and various other well-known additives can be present in any or all of the above mentioned layers.

Conductive layers underlying a transparent magnetic recording layer typically exhibit an internal resistivity of less than $1\times10^{10}$ ohms/square, preferably less than $1\times10^{9}$ ohms/square, and more preferably, less than $1\times10^{8}$ ohms/square.

Photographic elements of this invention can differ widely in structure and composition. For example, the photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in Research Disclosure, Item 36230 (Jun. 1994). Photographic elements can be either simple black-and-white or monochrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in Research Disclosure, Vol. 176, Item 17643 (Dec., 1978).

Photographic elements protected in accordance with this invention may be derived from silver-halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion-picture prints or they can be imaged elements that are viewed by reflection, such a paper prints. Because of the amount of handling that can occur with paper prints and motion picture prints, they are the preferred imaged photographic elements for use in this invention.

While a primary purpose of applying an overcoat to imaged elements in accordance with this invention is to protect the element from physical damage, application of the overcoat may also protect the image from fading or yellowing. This is particularly true with elements that contain images that are susceptible to fading or yellowing due to the action of oxygen. For example, the fading of dyes derived from pyrazolone and pyrazoloazole couplers is believed to be caused, at least in part, by the presence of oxygen, so that the application of an overcoat which acts as a barrier to the passage of oxygen into the element will reduce such fading.

Photographic elements in which the images to be protected are formed can have the structures and components shown in Research Disclosures 37038 and 38957. Other structures which are useful in this invention are disclosed in commonly owned U.S. Ser. No. 09/299,395, filed Apr. 26, 1999 and U.S. Ser. No. 09/299,548, filed Apr. 26, 1999, incorporated in their entirety by reference. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

The photographic element can contain additional layers, such as filter layers, interlayers, overcoat layers, subbing layers, and the like. All of these can be coated on a support that can be transparent (for example, a film support) or reflective (for example, a paper support). Photographic elements protected in accordance with the present invention may also include a magnetic recording material as described in Research Disclosure, Item 34390, Nov. 1992, or a transparent magnetic recording layer such as a layer containing magnetic particles on the underside of a transparent support as described in U.S. Pat. No. 4,279,945 and U.S. Pat. No. 4,302,523.

Suitable silver-halide emulsions and their preparation, as well as methods of chemical and spectral sensitization, are described in Sections I through V of Research Disclosures 37038 and 38957. Others are described in U.S. Ser. No. 09/299,395, filed Apr. 26, 1999 and U.S. Ser. No. 09/299,548, filed Apr. 26, 1999, which are incorporated in their entirety by reference herein. Color materials and development modifiers are described in Sections V through XX of Research Disclosures 37038 and 38957. Vehicles are described in Section II of Research Disclosures 37038 and 38957, and various additives such as brighteners, antifoggants, stabilizers, light absorbing and scattering materials, hardeners, coating aids, plasticizers, lubricants and matting agents are described in Sections VI through X and XI through XIV of Research Disclosures 37038 and 38957. Processing methods and agents are described in Sections MX and XX of Research Disclosures 37038 and 38957, and methods of exposure are described in Section XVI of Research Disclosures 37038 and 38957.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process,* 4th Edition, Macmillan, N.Y., 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying:

In one embodiment of a method of using a composition according to the present invention, a photographic element may be provided with a processing-solution-permeable overcoat having the above described composition overlying the silver halide emulsion layer superposed on a support. The photographic element is developed in an alkaline developer solution having a pH greater than 7, preferably greater than 8, more preferably greater than 9. This allows the developer to penetrate the protective coating. After the pH is reduced, for example in a bleach fix solution, the protective overcoat becomes relatively water resistant. The addition of polyvinyl alcohol, according to one embodiment of the present invention, facilitates this method. It has been found the polyvinyl alcohol can provide improved wettability of the surface during processing and, at the same time, allows more of the polyvinyl alcohol to be washed out during the processing, so that the final product is more water resistant. Suitably at least 30%, preferably greater than 50%, more preferably greater than 75% of the original amount of PVA in the overcoat is washed out during processing of the exposed photographic element, such that the final product is depleted in hydrophilic polymer and hence relatively more water resistant. Although the processing-solution-permeable overcoat does not require fusing, optional fusing may improve the water resistance further The overcoat layer in accordance with this invention is particularly advantageous for use with photographic prints due to superior physical properties including excellent resistance to water-based spills, fingerprinting, fading and yellowing, while providing exceptional transparency and toughness necessary for providing resistance to scratches, abrasion, blocking, and ferrotyping.

The present invention is illustrated by the following examples.

EXAMPLES

In the following examples, water resistance was tested as follows. Ponceau Red dye is known to stain gelatin through ionic interaction. If a photographic element comprised of one or more gelatin-containing layers is immersed in a Ponceau Red dye solution, the coating will adsorb a large quantity of dye and acquire a deep red color. An effective protective overcoat will prevent exposure of the gelatin in the element to the dye, and therefore will not be stained by immersion in the dye solution. Immersion in a solution of Ponceau Red is therefore a good test for the performance of the protective layer.

Ponceau Red dye solution was prepared by dissolving 1.0 g of dye in 1000 grams of a mixture of 5 wt. % acetic acid in water. The processed coatings were immersed in the dye solutions for 5 min, rinsed in water, and dried. They were then ranked visually according to the following scale:

A. The sample has no marks or red stain after immersion in dye solution. A ranking of "A" is most desirable, and indicates excellent stain and water protection of the gelatin layers by the protective overcoat.

B. Some lines (cracks) or speckles (pinholes) of red are visible, or the stained coating is a very light pink color. The protective layer provides incomplete protection.

C. Many defects, pinholes, or cracks, or the coating is very pink, though still distinguishable from a control sample with no protection (bare gelatin). The protective layer provides some protection, but is still reasonably permeable to water and dye.

D. The coating is stained a uniform dark red that is indistinguishable from a control with no protective overcoat; no protection.

A ranking of A is most desirable, B is acceptable, and C and D show inadequate or no protection. Within each grade, performance can be further distinguished by the use of "+" or "−" indications, where "+" means better performance than another comparable coating in the same experimental sequence, and "−" means worse.

Glass Transition Temperature And Melting Temperature

Both glass transition temperature (Tg) and melting temperature (Tm) of the dried-down polymer material were determined by differential scanning calorimetry (DSC), using a heating rate of 20° C./minute. Tg is defined herein as the inflection point of the glass transition and Tm is defined herein as the peak of the melting transition.

Particle Size Measurement

All particle sizes were measured by Photon Correlation Spectroscopy using a Zetasizer Model DTS5100, manufactured by Malvern Instruments.

Preparation and Characterization of Overcoat Polymers

Preparation of Polyurethane PU-A

A mixture of 2270 g (2.64 mole) Polycarbonate polyol PC1733 (Zeneca Chemicals, Peabody Mass. 01961), 306 g (2.28 mole) dimethylol propionic acid, DMPA, 654.3 g (7.26 mole) 1,4-Butanediol, 300 g (2.83 mole) diethylene glycol, and 4250 g tetrahydrofuran was placed in a reactor, and 1300 g tetrahydrofuran distilled off under a nitrogen atmosphere to dry the reagents and the vessel. The resulting solution was cooled to 40° C. A catalyst (4.29 g dibutyltin dilaurate) and 3334.4 g (15.00 mole) isophorone diisocyanate were added in three portions over a period of 30 minutes. The temperature of the reactor was then gradually increased (over a period of 75 minutes) to 90° C., and the reaction allowed to proceed at this temperature overnight. Examination of the reaction by infrared spectroscopy showed a small amount of isocyanate remained. Diethyleneglycol (48.5 g, 0.457 mol), dimethylol propionic acid (15 g, 0.112 mol) and 1,4-butanediol (15 g, 0.166 mol) were added, and the reaction held at 90° C. for an additional 5 hours. The viscous product was diluted with 7.5 kg of acetone and then cooled to 20° C. Potassium hydroxide (135 g) dissolved in 150 mL water was added, followed by surfactant (Triton 770 (Rohm and Haas), 229 g of a 30% solution) and 16 kg of distilled water. The reaction formed a homogeneous cloudy dispersion on stirring. Finally, solvent (4.5 kg) was removed by distillation, and an additional 8 kg of water were added. The resulting translucent dispersion contained 19.5% solids, with a weight average molecular weight of 19100 D, and a number average molecular weight of 8010 D. PU-B In a 500 mL flask equipped with a stirrer, nitrogen inlet and a condenser was charged with 148.12 g sodiosulfoisophthalic acid, 530.00 g Tone 0200 (a polycaprolactone polyol, molecular weight of 530, available from Union Carbide) and titanium (IV) isopropoxide at 200 ppm based on mixture of sodiosulfoisophthalic acid and Tone 0200. With stirring the mixture was heated to 250° C. When the mixture became clear (approx. 2 hrs), the temperature was increased to 270° C. and maintained at this temperature for 2 additional hour. Methanol condensate collected was approximately 15.8g indicating transesterification was essentially complete. The reaction product (called SIP-diol) was bottled and used without further purification.

A 2-liter resin flask equipped with thermometer, stirrer, water condenser and a vacuum outlet was charged with 245.48 grams (0.19 moles) of SIP-diol and dewatered under vacuum at 100° C. The flask was placed in a controlled temperature bath. Vacuum was released and 54.79 grams (0.24 moles) of bisphenol-A, 64.89 grams (0.72 moles) 1,4-butanediol, 150 grams of 2-butanone and 40 drops of dibutyltin dilaurate (catalyst) were added at 40° C. The contents of the flask were stirred and heated to 82° C. to obtain a homogeneous solution. After cooling to 70° C., 226.74 grams (1.02 moles) of isophorone diisocyanate and 10 grams of 2-butanone were added. The temperature was again raised to 82° C. and maintained for 16 hours to complete the reaction, resulting in final polyurethane containing less than 3% free isocyanate, as monitored by Infrared spectroscopy of the absorption peak at 2240 wave number. 2000 grams of water was added to the reaction flask under high shear to form a stable aqueous dispersion. 2-Butanone was removed by heating under vacuum to give an aqueous dispersion at 40% solids with a mean particle size of 143 nm. A sample of the polymer isolated by drying this dispersion had a glass transition temperature of 44° C. as measured by DSC, and a weight average molecular weight of 5,580 PU-2 (BB9305-155)

PU-C was prepared following the same procedure as for PU-1 except the amount of SIP-diol, Bisphenol-A and 1,4-butanediol was changed to 122.74 grams, 60.27 grams and 71.28 grams respectively. The glass transition temperature of the resulting polyurethane was 63° C. as measured by DSC, and the weight average molecular weight was 15,900.

PU-D

In a 2-liter resin flask equipped with thermometer, stirrer, water condenser and a vacuum outlet, 51.6 g PC1733 (a polycarbonate polyol, molecular weight of 860, available from Stahl) was placed in and dewatered under vacuum at 100° C. The vacuum was released and added 10.20 g dimethylol propionic acid, 10.0 g 2,2-oxydiethanol, 24.33 g 1,4-butanediol, 180 grams 2-butanone and 20 drops of dibutyltin dilaurate (catalyst) while stirring. Adjusted temperature to 80° C., when a homogeneous solution was obtained. Isophorone diisocyanate (111.20 g) was slowly added, followed by 10 grams of 2-butanone. The temperature was increased to 82° C. and maintained for about 16 hours to complete the reaction, resulting in an intermediate containing less than 3% free isocyanate. The reaction mixture was diluted with 75 g tetrahydrofuran and neutralized with 19.7 g of 45% potassium hydroxide solution to achieve 95% stoichiometric ionization based on dimethylol propionic acid. Distilled water (1300 g) was added to the neutralized mixture under high shear to form a stable aqueous dispersion, from which 2-butanone was removed by distillation under vacuum. The resulting polyurethane was found to have a weight average molecular weight of 20,600 and glass transition temperature of 70.7° C.

Ethyl Acrylate/ Vinylidene Chloride/Itaconic Acid (10/88/2), (Vinyl Polymer V-A)

Demineralized water (44 kg) was added to a 20 gallon, stainless-steel reactor. The system was purged for 15–30 minutes with nitrogen. The temperature was set at 15° C. and the stirrer was set at 150 RPM. The following reagents were then added to the reactor, in order: 104.6 g potassium metabisulfite dissolved in 500 ml demineralized water, 421.9 g itaconic acid, 2109.5 g ethyl acrylate, 18.56 kg of vinylidene chloride, 469 g of Dowfax™ 2EP (Dow Chemical Company) rinsed in with 1 kg demineralized water, and 104.6 g potassium persulfate dissolved in 1.5 kg demineralized water. The reactor port and the vent were closed. The reactor was pressurised to 2 psi with nitrogen. The internal temperature was set to 40° C., and held there for 16–20 hours. The product was then cooled to 20° C., and the vacuum was broken the nitrogen. The product was filtered through cheesecloth, yielding a latex dispersion with a mean particle size of 77 nm. The glass transition temperature of a dried sample of the latex was found to be 9° C. as measured by DSC.

Synthesis of Poly(ethyl methacrylate-co-butyl acrylate) 80/20 wt % Emulsion Polymer (Vinyl Polymer V-B)

A mixture of 824 mL demineralized water and 22.4 g of 30% Triton 770 (Rohm and Haas) was placed in a 2 liter flask. This mixture was heated to 80° C. under a nitrogen atmosphere and stirred at 100 RPM. A mixture of 467 ml of demineralized water, 11.2 g of 30% Triton 770, 537.8 g of ethyl methacrylate, and 134.4 g of butyl acrylate was placed in a 2 L header flask attached to the reactor. This mixture was stirred vigorously to form an emulsion. The reactor contents were heated to 80° C., and 1.89 g of sodium persulfate was added. The monomer emulsion charge was added to the reactor at a rate of approximately 14 mL/min (total charge time about 90 min). When the monomer emulsion addition was complete the reactor contents were stirred for two hours at 80° C.. At the end of this time, the vessel was cooled to 60° C. Erythorbic acid (0.89g) dissolved in 10 ml of water was added. Hydrogen peroxide in water (32 g of 2.77%) was then added over a period of about 30 min. The reactor contents were stirred for an additional hour at 60° C., and then cooled to 25° C. The resulting latex suspension was filtered through cheesecloth. The final suspension comprised 32.6% solids, and had a mean particle size of 77 nm. The glass transition temperature of a dried sample of the polymer was 36C.

Synthesis of Poly(butyl methacrylate) Emulsion Polymer (Vinyl Polymer V-C)

To a 2 liter flask was added 824 ml of demineralized water and 22.4 g of 30% Triton 770. This mixture was heated to 80° C. in a nitrogen atmosphere and stirred at 100 RPM. A mixture of 467 ml of demineralized water, 11.2 g of 30% Triton 770, and 672.3 g of butyl methacrylate was placed in a 2 L header flask and stirred vigorously to form an emulsion. The reaction flask was then heated to 80° C. and 1.89 g of sodium persulfate added to the reaction flask. The monomer emulsion charge was added to the reactor at a rate of approximately 14 mL/min (total charge time about 90 min). When the monomer emulsion addition was complete the reactor contents were stirred for two hours at 80° C. At the end of this time, the vessel was cooled to 60° C. Erythorbic acid (0.89g) dissolved in 10 ml of water was added. Hydrogen peroxide in water (32 g of 2.77%) was then added over a period of about 30 min. The reactor contents were stirred for an additional hour at 60° C., and then cooled to 25° C. The final suspension had a mean particle size of 79 nm. The glass transition temperature of a dried sample of the polymer was 29C.

Preparation of the Photographic Samples:

Multilayer photographic samples were prepared by coating in sequence a blue-light sensitive layer, an interlayer, a green-light sensitive layer, a UV layer, a red-light sensitive layer, a UV layer and an overcoat on photographic paper support. The constituents of the overcoat layer were varied according to the kind of protective layer desired. The coatings could be carried out in a single-pass operation using a multilayer slide hopper to apply all of the various melts, including the protective overcoat layer. Alternatively, the coatings could also be prepared from a multilayer rug in which all the layers except the overcoat layer were applied using a slide hopper, and then the overcoat layer and hardener (bis(vinylsulfonyl)methane) were subsequently applied in a separate coating operation using an extrusion hopper. The second method was commonly used to screen many different polymers for their ability to provide an effective overcoat.

The components in each individual layer are described below in Table 1 and Table 2 below.

TABLE 1

| Layer | Item | Lay-down (mg/ft$^2$) |
|---|---|---|
| Layer 1 | Blue Sensitive Layer | |
| | Gelatin | 121.90 |
| | Blue-light sensitive AgX | 21.10 |
| | Y-1 | 38.50 |
| | Di-n-butyl phthalate | 17.33 |
| | ST-23 | 38.50 |
| | ST-16 | 0.88 |
| | Benzenesulfonic acid, 2,5-dihydroxy-4-(1-methylheptadecyl)-, monopotassium salt | 0.88 |
| | 1-Phenyl-5-mercaptotetrazole | 0.013 |
| Layer 2 | Interlayer | |
| | Gelatin | 70.00 |
| | ST-4 | 6.13 |
| | Di-n-butyl phthalate | 17.47 |
| | Disulfocatechol disodium | 6.00 |
| | Nitric acid | 0.524 |
| | SF-1 | 0.18 |
| Layer 3 | Green Sensitive Layer | |
| | Gelatin | 132.00 |
| | Green-light sensitive AgX | 7.30 |
| | M-1 | 22.10 |
| | Di-n-butyl phthalate | 7.85 |
| | Diundecyl phthalate | 3.36 |
| | ST-1 | 16.83 |
| | ST-2 | 5.94 |
| | ST-3 | 56.09 |
| | 1-Phenyl-5-mercaptotetrazole | 0.05 |
| Layer 4 | UV Layer | |
| | Gelatin | 66.00 |
| | UV-1 | 15.98 |
| | UV-2 | 2.82 |
| | ST-4 | 5.14 |
| | Di-n-butyl phthalate | 3.13 |
| | 1,4-Cyclohexylenedimethylene bis(2-ethylhexanoate) | 3.13 |
| Layer 5 | Red Sensitive Layer | |
| | Gelatin | 126.0 |
| | Red-light sensitive AgX | 18.70 |
| | C-1 | 35.40 |
| | Di-n-butyl phthalate | 34.69 |
| | 2-(2-Butoxyethoxy)ethyl acetate | 2.90 |

TABLE 1-continued

| Layer | Item | Lay-down (mg/ft$^2$) |
|---|---|---|
| | ST-4 | 0.29 |
| | UV-1 | 22.79 |
| | Silver phenyl mercaptotetrazole | 0.05 |
| | Benzenesulfonothioic acid, 4-methyl-, potassium salt | 0.26 |
| Layer 6 | UV Layer | |
| | Gelatin | 50.00 |
| | UV-1 | 12.11 |
| | UV-2 | 2.13 |
| | ST-4 | 3.90 |
| | Di-n-butyl phthalate | 2.37 |
| | 1,4-Cyclohexylenedimethylene bis(2-ethylhexanoate) | 2.37 |
| Layer 7 | Overcoat | |
| | Gelatin | 60.0 |
| | SF-1 | 1.00 |
| | SF-2 | 0.39 |
| | Bis(vinylsulfonyl)methane | 9.14 |

These layers were applied on photographic paper support, comprising several sublayers as indicated:

The Photographic paper support:

| | |
|---|---|
| Sublayer 1: | resin coat (TITANOX pigment and optical brightener in polyethylene) |
| Sublayer 2: | paper |
| Sublayer 3: | resin coat (polyethylene) |

The structures of the materials indicated by reference numbers in Table 1 are shown in the following Table.

TABLE 2

| Reference No. | Structure |
|---|---|
| SF-1 Olin® 10G | 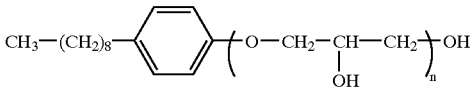 |
| SF-2 | $CF_3.(CF_2)_7.SO_3Na$ |
| Alkanol® XC SF-3 | 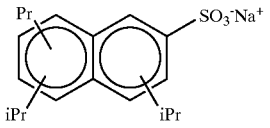 |
| SF-4 | 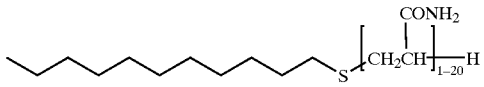 |
| UV-1 | 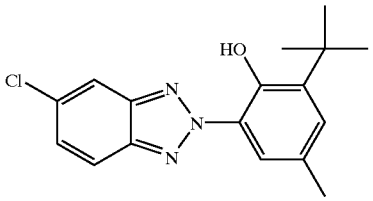 |

TABLE 2-continued

| Reference No. | Structure |
|---|---|
| UV-2 | 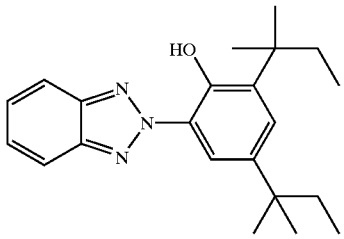 |
| C-1 | 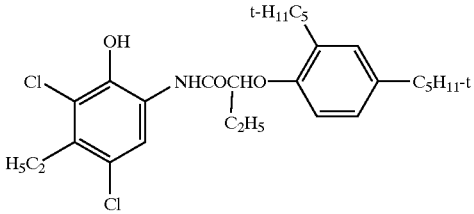 |
| M-1 | 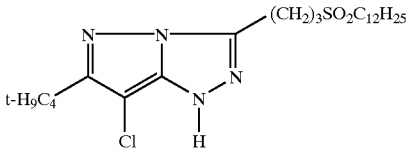 |
| ST-1 | 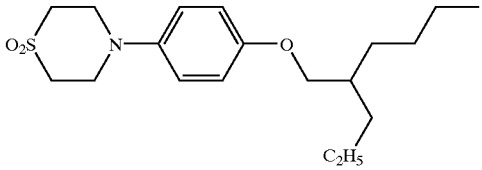 |
| ST-2 | 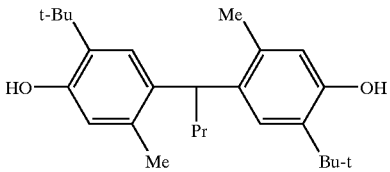 |
| ST-3 | 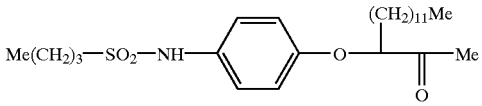 |
| ST-4 | 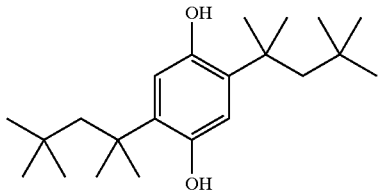 |

TABLE 2-continued

| Reference No. | Structure |
|---|---|
| Y-1 | 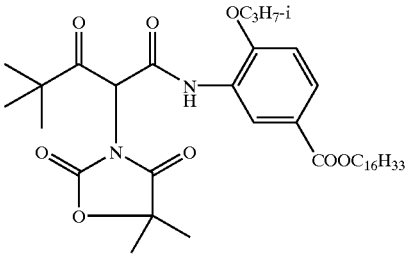 |
| ST-16 | 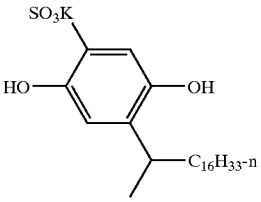 |
| ST-23 | 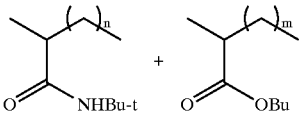 n:m = 1:1; MW = 75,000–100,000 |

EXAMPLE 1

Coating sample 1. This coating was prepared using a single pass slide hopper application. The overcoat layer comprised a mixture of polyvinyl alcohol (Airvol 203$^{(R)}$) (50 mg/ft$^2$), and a dispersion of an epoxy-containing polymer dispersion (160 mg/ft2 combined laydown of Carboset® 525 (an acrylic copolymer from BF Goodrich Specialty Chemicals) and Epon® 1001F (epoxy resin from Shell Chemical Company). The dispersion was prepared as follows:

Carboset 525™ (561.6 g) and Epon 1001F™ (1310.4g) were dissolved in a mixture of 4043.5 g of ethyl acetate, 449.3 g of acetone. Just before use, 1377.8 g isopropanol and 201.9 g of 20% potassium hydroxide in water were added with stirring. This mixture was added slowly, with good stirring, to an aqueous solution comprised of 10678.3 g of distilled water, 207.6 g of polyvinyl alcohol (80% hydrolyzed, approximate MW 9000–10000, Aldrich Chemical Company), and 1570.1 g of a 10% solution of Alkanol XC surfactant (DuPont). The resulting suspension was subjected to homogenization using a high-pressure homogenizing device (Microfluidics Corporation Microfluidizer).

The homogenized mixture was heated in a water bath to 65° C. under a stream of nitrogen, to remove most of the organic solvent. After several hours, the resulting evaporated dispersion was cooled to 25° C. and filtered through cheesecloth. The particle size of the resulting suspension was found to have a median size of around 200 nm.

Several samples of the coating were subjected to a simulated photographic process. The process was carried out under room light illumination, so that a "developer" solution was used lacking p-phenylenediamine color developer, but was otherwise identical in composition to the developer in the normal RA-4 process. The process consists of four steps:

A. "Developer" (45 seconds, 40° C.)

B. Bleach/Fix (45 seconds, 40° C.)

C. Wash (180 seconds, 40° C.).

D. Drying in air heated to various temperatures.

The present invention involves the composition of the solution in step C. The check is the normal process, in which water is used. The process of the invention uses a solution comprising a variable amount of a suitable organic, water-miscible co-solvent. The effect of various drying conditions on the performance of the protective overcoat was also investigated. The results of these experiments are shown in Tables 3 and 4.

TABLE 3

| Solvent (Butyl carbitol) Concentration in wash solution | Drying Conditions 30° C. | 36° C. | 50° C. |
|---|---|---|---|
| 0% (check) | D | D | A |
| 0.25% (invention) | D | B | A |
| 0.5% (invention) | D+ | A− | A |
| 1.0% (invention) | A | A | A |
| 2.0% (invention) | A | A | A |
| **Solvent (Benzyl alcohol) Concentration** | **Drying Conditions 30° C.** | **36° C.** | **50° C.** |
| 0% (check) | D | D | A |
| 0.25% (invention) | D | C | A |
| 0.5% (invention) | B− | A | A |
| 1.0% (invention) | A | A | A |
| 2.0% (invention) | A | A | A |

The results shown in Table 3 show that the water and stain protection afforded by an overcoat of this formulation is poor under normal conditions, unless high drier temperature (50° C.) is used. In the process of the invention, the incorporation of a small amount of organic solvent (in this case, either butyl carbitol or benzyl alcohol) in the wash step, provides a fully converted overcoat, with excellent protective ability, even if mild drying is used. Further, the amount of solvent used can be adjusted to compensate for lower temperature drying.

EXAMPLE 2

Coating sample 2. In the coating of this example, a different polymer overcoat layer comprising a mixture of a polyurethane polymer PU-A (160 mg/ft$^2$) and polyvinyl alcohol (Airvol® 203; 50 mg/ft$^2$) was applied in a single-pass slide-hopper coating operation. Processing, drying, and testing were carried out as described in Example 1. The results are summarized in Table 4.

TABLE 4

| Solvent (Butyl carbitol) Concentration | Drying Conditions 30 C. | 36 C. | 50 C. |
|---|---|---|---|
| 0% (check) | C | C | B+ |
| 0.25% (invention) | C | C | A− |
| 0.5% (invention) | C | C | A− |
| 1.0% (invention) | C | B | A− |
| 2.0% (invention) | B | B | B |

TABLE 5

| Solvent in wash | Concentration | Drying Conditions 30° C. | 36° C. | 50° C. |
|---|---|---|---|---|
| benzyl alcohol | 0% (check) | C | C | C |
| | 0.25% | C | C | C+ |
| | 0.5% | C | C− | C− |
| | 1.0% | C | D | D+ |
| | 2.0% (invention) | B | D | D |
| t-butanol | 0% (check) | C | n.a.* | n.a. |
| | 5% | B | n.a. | n.a. |
| | 7% | B+ | n.a. | n.a. |
| | 11% | A− | n.a. | n.a. |
| methanol | 7% | C | n.a. | n.a. |
| | 11% | B− | n.a. | n.a. |

*n.a. = datum not available

In this case, the overcoat polymer gives mediocre performance at best after water washing, even if high temperature drying is used. Incorporation of small quantities of butyl carbitol in the wash solution gave substantially improved performance, but only at high temperature. Small improvement in performance at lower temperature was only seen at relatively high solvent concentrations (1 to 2%). Benzyl alcohol was not very beneficial for this polymer. On the other hand, somewhat higher concentrations (11%) of t-butanol in the wash solution gave essentially complete conversion of the overcoat polymer and yielded a protective overcoat with good properties even using low temperature drying. Some improvement was even seen with a very hydrophilic solvent (methanol) if used at sufficient concentration. This result shows that the nature of the solvent and that of the overcoat polymer are coupled and must be cooptimized to give good performance.

EXAMPLE 3

Two different dispersions of epoxy prepolymer were prepared and coated using the procedure of Example 1. One of these dispersions, used to make coating sample 4, comprises no Carboset® 525 polymer; the second dispersion, used to make coating sample 3, comprises the mixture of Carboset® 525 and Epon® 1001F, in a ratio of 1:2.33 by weight. The hydrophobic components of the overcoat (that is, the combination of Carboset® 525 and Epon®1001F polymers) were coated at a level of 160 mg/ft$^2$ together with polyvinyl alcohol (Airvol 203™) (40 mg/ft$^2$). Samples of the resulting coating were processed using several washing and drying conditions. In all cases, for convenience, the process was carried out in white light using a first processing solution containing no p-phenylene diamine developer. After processing in a bleach-fix bath to remove silver salts, the final washing was carried out in one of three ways: in water (control), in a water solution containing 1% butyl carbitol (invention) or I % benzyl alcohol (invention). Drying was carried out either at low temperature (36° C.) or high temperature (52° C.) in an oven equipped with air circulation.

After drying, the water-washed coating was cut in half, and one half subjected to a fusing process by passing through heated pressure rollers at very high temperature (175° C.). This condition is very effective at providing conversion of the overcoat to a sealed condition, even of polymers that are very resistant to conversion under more moderate conditions.

TABLE 6

| Coatimg sample No. | OC POLYMER | Condition: Water wash, dry at 36° C. (control) Not fused[a] | Water wash Dry at 36° C. (control) Fused[b] | 1% Benzyl alcohol in wash, dry at 52° C. (invention) not fused[a] | 1% Butyl Carbitol in wash, dry at 36° C. (invention) not fused[a] | 1% Butyl Carbitol in wash, dry at 52° C. (invention) not fused[a] |
|---|---|---|---|---|---|---|
| 3 | CARBOSET 525/ EPON1001F | C | A | A | A | A |
| 4 | EPON1001F | D+ | A− | D | B+ | C− |

[a]No treatment of the coatings was provided after drying.
[b]The coatings were passed through a set of heated pressure rollers after drying and prior to evaluation. This treatment is very effective at promoting conversion of the overcoat layer from a permeable to a non-permeable form.

This example shows that the use of a small amount of solvent in the wash solution during photographic processing can substantially improve the performance of the overcoat layer. In some cases, this treatment is sufficient to yield excellent performance from an overcoat layer that would otherwise require a separate processing step (fusing with a pressure roller) in order to perform satisfactorily.

EXAMPLE 4

The dispersion of epoxy prepolymer prepared and coated using the procedure of Example 1 ("Epoxy Dispersion 1") was used in the following coating samples. In this experiment, the laydown of epoxy prepolymer and polyvinylalcohol binder were varied as indicated in Table 7. Samples of the resulting coating were processed using several washing and drying conditions. In all cases, for convenience, the process was carried out in white light using a first processing solution containing no p-phenylene diamine developer. After processing in a bleach-fix bath to remove silver salts, the final washing was carried out in one of three ways: in water (control), in a water solution containing 1% butyl carbitol (invention) or 1% benzyl alcohol (invention). Drying was carried out either at low temperature (36° C.) or high temperature (52° C.) in an oven equipped with air circulation.

TABLE 7

| Coating Sample No. | OC | ratio of epoxy/pva | Water wash, dry at 36° C. (control) | Water wash, dry at 52 C. (control) | 1% Butyl Carbitol, dry at 36° C. (invention) | 1% Butyl Carbitol, dry at 52° C. (invention) |
|---|---|---|---|---|---|---|
| 5 | Epoxy Dispersion 1, 160 mg/ft$^2$, Airvol ® 203, 50 mg/ft$^2$ | 3.2 | D | A− | A | A |
| 6 | Epoxy Dispersion 1, 144 mg/ft$^2$, Airvol ® 203, 36 mg/ft$^2$ | 4 | D | B | B+ | A |
| 7 | Epoxy Dispersion 1, 128 mg/ft$^2$, Airvol ® 203, 32 mg/ft$^2$ | 4 | D | C | C | B |
| 8 | Epoxy Dispersion 1, 160 mg/ft$^2$, Airvol ® 203, 50 mg/ft$^2$ | 3.2 | D | A− | A | A |
| 9 | Epoxy Dispersion 1, 144 mg/ft$^2$, Airvol 203, 45 mg/ft$^2$ | 3.2 | D | A− | A | A |
| 10 | Epoxy Dispersion 1, 128 mg/ft$^2$, Airvol ® 203, 40 mg/ft$^2$ | 3.2 | D | C+ | A− | A− |

These samples show that overcoat compositions that otherwise would not provide good performance can be made to perform well in the process of the invention. For example, with this overcoat formulation, a laydown of at least 45 mg/ft$^2$ of the epoxy polymer is required in order to obtain a protective overcoat showing adequate performance (a rating of A− or better), and even then high temperature drying is required for conversion. With 1% butyl carbitol in the wash solution, good performance is obtained with low temperature drying for samples that require high temperature in the absence of the solvent to obtain adequate performance (parts 27 and 30). Significantly, even coatings with lower laydown (parts 31 and 32), or with higher ratios of epoxy polymer to polyvinylalcohol (parts 28 and 29) can be made to perform adequately by solvent treatment, particularly when coupled with high temperature drying. Thus, the process of the invention allows greater coating and processing flexibility, as well as greater materials economy, in the implementation of incorporated protective overcoat technology.

EXAMPLE 5

Several coatings were prepared by applying an overcoat layer to a prepared multilayer rug as described above. In each coating a different overcoat polymer was used, as shown in TABLE 5.

TABLE 5

| Coating Sample No. | Overcoat Formulation | |
|---|---|---|
| 11 | No overcoat (control) | |
| 12 | 50 mg/ft$^2$ PVA (AIRVOL 203), 88% hydrolyzed, 4 cPs) | 160 mg/ft$^2$ V-A Vinyl latex |
| 13 | 50 mg/ft$^2$ PVA (AIRVOL 203), 88% hydrolyzed, 4 cPs) | 160 mg/ft$^2$ V-B Vinyl latex, Tg = 36° C. |
| 14 | 50 mg/ft$^2$ PVA (AIRVOL 203), 88% hydrolyzed, 4 cPs) | 160 mg/ft$^2$ V-C Vinyl latex, Tg = 29° C. |
| 15 | 50 mg/ft$^2$ PVA (AIRVOL 203), 88% hydrolyzed, 4 cPs) | 160 mg/ft$^2$ Polyurethane PU-B |
| 16 | 50 mg/ft$^2$ PVA (AIRVOL 203), 88% hydrolyzed, 4 cPs) | 160 mg/ft$^2$ Polyurethane PU-C |
| 17 | 50 mg/ft$^2$ PVA (AIRVOL 203), 88% hydrolyzed, 4 cPs) | 160 mg/ft$^2$ Polyester PE-A (Eastman AQ ® polyester AQ55) |
| 18 | 50 mg/ft$^2$ PVA (AIRVOL 203), 88% hydrolyzed, 4 cPs) | 160 mg/ft$^2$ Polyurethane PU-D |

Samples of these coatings were processed as described in EXAMPLE 1, using different processing conditions in the washing step. As a control, one set of samples was processed using just water in the wash. Two other sets were processed according to the invention, using water containing 1% and 2% butyl carbitol as washing solutions. With each processing condition, different drying conditions were also used, in which the air temperature of the dryer was varied. Three different temperatures were employed, 30° C., 36° C, and 52° C. After drying, the samples were soaked in Ponceau Red dye solution for five minutes, rinsed in water, and dried to evaluate the protective character of the overcoat. The results are shown in TABLE 6.

TABLE 6

| Dryer temperature | Water (control) | | | 1% Butyl carbitol (invention) | | | 2% Butyl carbitol (invention) | | |
|---|---|---|---|---|---|---|---|---|---|
| Sample number | 30° C. | 36° C. | 52° C. | 30° C. | 36° C. | 52° C. | 30° C. | 36° C. | 52° C. |
| 11 | D | D | D | D | D | D | D | D | D |
| 12 | D | D | D | C | C | B | C+ | C+ | B |
| 13 | B– | B– | B | B– | B | A– | B | B+ | A |
| 14 | B– | B– | B– | A– | A– | A– | A– | A– | A |
| 15 | D | D | D | C– | C | C | C | C | C |
| 16 | D | D | D | C | B | C– | C | B | C– |
| 17 | C+ | C+ | B– | A– | A– | A– | B+ | B+ | B+ |
| 18 | B | C+ | B | B+ | B+ | A– | A | A | A |

These examples include a number of polymers that do not readily form a film under normal processing conditions, even using high drier temperatures. The performance of each one is improved to some extent by the process of the invention, even though fully acceptable performance is not achieved in all cases. Furthermore, the use of larger concentrations of organic solvent (2% butyl carbitol rather than 1% butyl carbitol) shows larger improvements in most cases. Polymers of various structural types are all aided by solvent treatment. The Table includes examples of vinyl polymers (ethyl methacrylate-co-butyl acrylate, sample 19; butyl methacrylate homopolymer, sample 20), polyurethanes (sample 37), and polyesters (sample 17), all of whose barrier properties can be improved by treatment with an appropriate amount of solvent during the washing step.

The invention has been described in detail with particular reference to certain preferred embodiments thereof, but it will be understood that variations and modifications can be effected within the spirit and scope of the invention.

What is claimed is:

1. A method of making a photographic imaged element comprising:

(a) providing an imagewise exposed photographic imaging element comprising a support, at least one silver-halide emulsion layer superposed on a side of said support, a processing-solution-permeable precursor-protective layer overlying the silver-halide emulsion layer, said protective-precursor layer having a laydown of at least 0.54 g/m$^2$ (50 mg/ft$^2$) made from a coating composition comprising 30 to 95%, by weight of solids, of water-dispersible polymer in the form of particles having an average particle size of less than 500 nm, and 5 to 70%, by weight of solids, of water-soluble polymer such that more than 30 weight percent of the water-soluble polymer is washed out during photographic processing, wherein the weight ratio of water-dispersible polymer to water-soluble polymer is between 50:50 to 90:10;

(b) developing the photographic element in a developer solution having a pH greater than 7 to obtain a photographic imaged element;

(c) washing the developed photographic imaged element in a wash solution comprising a water-soluble organic solvent; and (d) drying the washed photographic imaged element of (c), in which an effective amount of the water-soluble organic solvent has been retained, in order to convert the layer with the water-dispersible polymer into a water-resistant protective layer.

2. The method of claim 1 wherein said water-dispersible polymer is selected from the group consisting of polyesters, polyamides, polyurethanes, polyureas, polyethers, polycarbonates, polyacid anhydrides, polymers derived from vinyl ethers, vinyl heterocyclic compounds, styrenes, olefins, halogenated olefins, unsaturated acids and esters thereof, unsaturated nitriles, vinyl alcohols, acrylamides and methacrylamides, and vinyl ketones, poly(epoxides) and copolymers thereof, and combinations thereof.

3. The method of claim 1 wherein said water-soluble polymer is selected from the group consisting of polyvinyl alcohol, cellulose ethers, poly(N-vinyl amides), polyacrylamides, polyesters, poly(ethylene oxide), dextrans, starch, uncrosslinked gelatin, whey, albumin, poly(acrylic acid), poly(ethyl oxazolines), alginates, gums, poly (methacrylic acid), poly(oxymethylene), poly (ethyleneimine), poly(ethylene glycol methacrylate), poly (hydroxy-ethyl methacrylate), poly(vinyl methyl ether), poly(styrene sulfonic acid), poly(ethylene sulfonic acid), poly(vinyl phosphoric acid) and poly(maleic acid), and combinations thereof.

4. The method of claim 1 wherein the weight average molecular weight of said water soluble polymer is less than 300,000.

5. The method of claim 1 wherein the weight average molecular weight of said water-soluble polymer is 1500 to 100,000.

6. The method of claim 1 wherein said water-soluble polymer is an epoxide polymer.

7. The method of claim 1 wherein said water-dispersible polymer is a polyurethane.

8. The method of claim I wherein, during drying, the photographic imaged element is substantially maintained at a temperature less than 100° C. and no fusing is employed.

9. The method of claim 1 wherein the water-soluble organic solvent is present in an effective amount of 0.1 to 15 percent by weight of the wash solution.

10. The method of claim 1 wherein said washing occurs after fixing and bleaching and said washing comprises the last solution in which the photographic imaged element is immersed during photographic process.

11. The method of claim 1 wherein the solvent is selected from the group consisting of alkyl, aryl, or alkaryl alcohols, alkyl amides, sulfoxides, sulfones, ethers, esters, ether esters, ketones, and ether alcohols.

12. The method of claim 11 wherein the solvent is selected from the group consisting of methanol, ethanol, propanol, isopropanol, butanol, isobutanol, tertiary butanol, phenol, substituted phenols, benzyl alcohol, formamide, dimethyl formamide, N-methylpyrrolidone, dimethylsulfoxide, dimethylsulfone, tetramethylene sulfone, glyme, diglyme, butyl carbitol, propyl carbitol, butyl carbitol acetate, acetone, methyl ethyl ketone, methyl isobutyl ether, cyclohexanone, acetonitrile, trimethylphosphate, triethyl phosphate, ethylene carbonate, butyl carbitol, propyl carbitol, and butyl carbitol acetate.

13. The method of claim 1 wherein wherein the wash solution is the final wash solution of a plurality of wash solutions used to treat the photographic imaged element.

14. The method of claim 1 wherein the imaging element is photographic paper and the imaged element is a photographic print.

15. The method of claim 1 wherein wherein the protective layer further comprises one or more addenda selected from the group consisting of UV absorbers, surfactants, emulsifiers, coating aids, lubricants, matte particles, rheology modifiers, crosslinking agents, antifoggants, inorganic fillers, pigments, magnetic particles and biocides.

* * * * *